US005282952A

United States Patent [19]

Sakaki

[11] Patent Number: 5,282,952

[45] Date of Patent: Feb. 1, 1994

[54] METHOD FOR PREPARING SUBSTRATE FOR LITHOGRAPHIC PRINTING PLATES, SUBSTRATE FOR LITHOGRAPHIC PRINTING PLATES PREPARED BY THE METHOD AND PRESENSITIZED PLATE COMPRISING THE SUBSTRATE

[75] Inventor: Hirokazu Sakaki, Shizuoka, Japan

[73] Assignee: Fuji Photo Film Co., Ltd., Minami-Ashigara, Japan

[21] Appl. No.: 745,414

[22] Filed: Aug. 15, 1991

[30] Foreign Application Priority Data

| | | | |
|---|---|---|---|
| Aug. 16, 1990 | [JP] | Japan | 2-215980 |
| Oct. 12, 1990 | [JP] | Japan | 2-274795 |
| Oct. 12, 1990 | [JP] | Japan | 2-274796 |

[51] Int. Cl.[5] ..... C25D 11/16

[52] U.S. Cl. ..... 205/153; 205/188; 205/201; 205/213; 205/921

[58] Field of Search ..... 205/153, 139, 127, 213, 205/214, 921, 188, 201

[56] References Cited

U.S. PATENT DOCUMENTS

| | | | |
|---|---|---|---|
| 4,204,919 | 5/1980 | Randall, Jr. et al. | 204/29 |
| 4,413,049 | 11/1983 | Beaudet et al. | 430/126 |
| 4,502,925 | 3/1985 | Walls | 204/33 |
| 4,554,216 | 11/1985 | Mohr | 428/469 |
| 4,604,341 | 8/1986 | Mohr | 430/278 |
| 4,686,021 | 8/1987 | Nakanishi et al. | 204/129.75 |

FOREIGN PATENT DOCUMENTS

| | | |
|---|---|---|
| 50-124705 | 10/1975 | Japan . |
| 51-063703 | 6/1976 | Japan . |
| 54-063902 | 5/1979 | Japan . |
| 54-63902 | 5/1979 | Japan . |
| 58-108195 | 6/1983 | Japan . |
| 63-57796 | 3/1988 | Japan . |
| 63-62795 | 3/1988 | Japan . |
| 2-221394 | 9/1990 | Japan . |
| 2160222A | 12/1985 | United Kingdom . |

OTHER PUBLICATIONS

JP54063902 May 1979 Japanese Patent Abstract.
63-62795 Mar. 1988 Japanese Patent Abstract.
JP51063703 Jun. 1976 Japanese Patent Abstract.
63-57796 Mar. 1988 Japanese Patent Abstract.
58-108195 Jun. 1983 Japanese Patent Abstract.
80013918 Apr. 1980 Japanese Patent Abstract.

*Primary Examiner*—John Niebling
*Assistant Examiner*—William T. Leader
*Attorney, Agent, or Firm*—Burns, Doane, Swecker & Mathis

[57] ABSTRACT

A method for preparing a substrate for lithographic printing plates comprises the steps of forming a hydrated oxide layer on the surface of an aluminum plate and then anodizing the plate in a sulfuric acid electrolyte; a lithographic printing plate comprises the substrate; and the substrate per se prepared by the method is also disclosed herein.

The presensitized plate for use in making lithographic printing plates which comprises the substrate has very high sensitivity which makes the presensitized plate applicable to new exposure methods and is capable of being developed with a developer of an aqueous solution system. The light-sensitive layer and the substrate of the presensitized plate are strongly adhered to one another and, therefore, the resulting lithographic printing plate has excellent printing durability and good printability.

11 Claims, No Drawings

METHOD FOR PREPARING SUBSTRATE FOR LITHOGRAPHIC PRINTING PLATES, SUBSTRATE FOR LITHOGRAPHIC PRINTING PLATES PREPARED BY THE METHOD AND PRESENSITIZED PLATE COMPRISING THE SUBSTRATE

BACKGROUND OF THE INVENTION

1. Field of the Invention

The present invention relates to a substrate for lithographic printing plates and a presensitized plate for use in making lithographic printing plates (hereinafter referred to as "PS plate") which comprises the substrate and more particularly to a substrate for lithographic printing plates which has good adhesion to a light-sensitive layer and can impart high sensitivity to the resulting PS plates and high printing durability to the resulting lithographic printing plate as well as a PS plate comprising the substrate.

2. Prior Art

In the printing industries, the PS plate has been one of the leading mainstreams of printing plates, because the handling thereof is very easy and the use thereof contributes to the reduction of labor required for making a printing plate and for printing and has widely been used in, for instance, usual commercial printing, newspaper-printing, form printing and printing of paper wares.

Recently, there has been an increased demand for further speeding up of and labor-reduction in the plate-making and printing processes. Under such circumstances, there have been proposed new plate-making systems and automated plate-making systems and correspondingly there have been desired for the development of PS plates excellent in sensitivity and developability, which are adapted to these new plate-making systems. For instance, when images are to be formed on a PS plate in a conventional method, an original film is brought into close contact with the PS plate under vacuum and then the assembly is irradiated with light, but in recent practice, there has been used a method for forming images which comprises imagewise exposing the PS plate by directly projecting enlarged images through a microfilmed original. In addition, there has also been adopted a method for forming images on a PS plate which comprises directly scanning a laser beam such as an argon ion laser beam, visible light rays or ultraviolet rays on the PS plate for imagewise exposing the same.

However, such PS plates must have extremely high sensitivity as compared with those conventionally used in order to form images by the foregoing new exposure methods. In addition to the requirement for the improvement in the sensitivity, there has been desired for the improvement in developers. More specifically, the conventional developers mainly comprise organic solvents, but they are unfavorable from the viewpoint of, for instance, safety of working environment and cost for developing treatments and, therefore, there has recently been desired for the development of developers mainly comprising aqueous solution systems.

To obtain a PS plate having high sensitivity, the light-sensitive layer on image areas must be strongly adhered to the surface of a substrate, the PS plate must be able to provide a lithographic printing plate having high printing durability and the non-image area obtained after development must be hardly contaminated.

To improve the adhesion between a light-sensitive layer and a substrate, there have been proposed a variety of methods, for instance, a method comprising anodizing a substrate in a phosphoric acid solution as disclosed in Japanese Patent Publication for Opposition Purpose (hereinafter referred to as "J.P. KOKOKU") Nos. Sho 46-26521, Sho 55-12877 and Sho 54-37522 and Japanese Unexamined Patent Publication (hereinafter referred to as "J.P. KOKAI") No. Sho 62-99198; a method comprising anodizing a substrate in a mixed acid solution of phosphoric acid and sulfuric acid as disclosed in J.P. KOKAI Nos. Sho 55-28400 and Sho 53-2103, U.S. Pat. No. 4,049,504 and Brit. Patent No. 1,240,577; a method comprising anodizing a substrate in a phosphoric acid solution and then further anodizing in an organic acid solution of, for instance, polyvinylsulfonic acid or phytic acid as disclosed in J.P. KOKAI Nos. Sho 57-89497 and Sho 57-89498 and U.S. Pat. No. 4,022,670; and a method comprising anodizing a substrate in a phosphoric acid solution and then anodizing it in an inorganic acid solution of, for instance, sulfuric acid or boric acid instead of an organic acid as disclosed in J.P. KOKAI No. Sho 59-193298 and J.P. KOKOKU No. 46-43123. Further, well-known are those methods comprising anodizing a substrate in an electrolyte of a phosphate compound such as $Na_3PO_4$, $NaH_2PO_4$ and $Na_2HPO_4$ as disclosed in J.P. KOKAI Nos. Sho 60-56073, Sho 59-15644 and Sho 60-52596 or combination thereof. However, all of these methods use phosphate compounds and, therefore, eutrophication of drainage systems is unavoidable. Further, this becomes a cause of brown tide and the putrefaction of lakes or the like and is undesirable from the viewpoint of environmental assurance. For this reason, there has been desired for the development of a solution which can be replaced with those mainly comprising phosphate compounds, i.e., a solution free of phosphate compounds used in the anodization.

When a positive-working PS plate which comprises a positive-working light-sensitive layer containing o-quinone diazide is formed by applying a positive-working light-sensitive layer containing o-quinone diazide onto the surface of an aluminum substrate which have been anodized by the method as described above, the non-image area obtained therefrom is colored after development. To solve this problem, there has been proposed a method in which an aluminum substrate is treated with a condensed sodium arylsulfonate (see, for instance, J.P. KOKAI No. Sho 57-195697). This method makes it possible to prevent the coloration of non-image area, but on the contrary, the printing durability of the resulting lithographic printing plate is impaired.

SUMMARY OF THE INVENTION

Accordingly, an object of the present invention is to provide a substrate for lithographic printing plates which can provide a PS plate having very high sensitivity which makes the plate applicable to the foregoing new exposure methods and developability with a developer of an aqueous solution system and which can provide a lithographic printing plate having excellent printing durability and printability.

Another object of the present invention is to provide a PS plate comprising the foregoing substrate, which has very high sensitivity which makes the plate applicable to the foregoing new exposure methods and developability with a developer of an aqueous solution system and which can provide a lithographic printing plate having excellent printing durability and printability.

A further object of the present invention is to provide a positive-working PS plate in which an image area is strongly adhered to a substrate and which hardly causes any coloration of non-image areas.

The inventor of this invention has conducted various studies to solve the foregoing problems, found out that the objects of the present invention can effectively be achieved by subjecting a specific treatment to the surface of an aluminum plate and has thus completed the present invention.

Thus, according to an aspect of the present invention, there is provided a method for preparing a substrate for lithographic printing plates which comprises the steps of forming a hydrated oxide layer on the surface of an aluminum plate and then anodizing the plate in an electrolyte of sulfuric acid.

According to another aspect of the present invention, there is provided a PS plate which comprises a substrate which is formed by a method comprising forming a hydrated oxide layer on the surface of an aluminum plate and then anodizing it in an electrolyte of sulfuric acid.

DESCRIPTION OF THE PREFERRED EMBODIMENTS

The present invention will hereinafter be explained in more detail.

The aluminum plate used in the present invention is a plate-like material of pure aluminum or an aluminum alloy comprising aluminum as a main component and a small amount of foreign atoms. Examples of the foreign atoms are silicon, iron, manganese, copper, magnesium, chromium, zinc, bismuth, nickel and titanium. The content of these foreign atoms is in the order of not more than 10% by weight. Pure aluminum is preferable in the present invention, but the production of completely pure aluminum is impossible due to the limits in the refining technique. Therefore, it is preferred to use aluminum having the lowest possible content of the foreign atoms. The foregoing aluminum alloys having the foreign atom content defined above may be materials applicable to the present invention without any problem. As discussed above, the aluminum plates used in the present invention are not restricted to those having a specific composition and thus those conventionally known and currently used may be employed in the invention. The thickness of the aluminum plates suitably used in the invention ranges from about 0.1 to 0.5 mm.

Rolling oils must be removed from the surface of an aluminum plate prior to the anodization of the plate and this treatment is in general performed by degreasing with an aqueous solution of a surfactant or an alkali and if necessary, the aluminum plate is grained.

The graining treatments include, for instance, a method comprising mechanically roughening the surface, a method comprising electrochemically dissolving the surface and a method comprising chemically and selectively dissolving the surface. Examples of the methods comprising mechanically roughening the surface include known methods such as ball graining, brush graining, blasting and buffing methods. Examples of the electrochemical surface-roughening methods are those comprising passing a DC or AC current through the aluminum plate in an electrolyte of hydrochloric acid or nitric acid. Moreover, it is also possible to use a combination of these methods as disclosed in J.P. KOKAI No. Sho 54-63902.

The aluminum plate thus surface-roughened is, if necessary, subjected to alkali etching and neutralization.

A hydrated oxide layer is formed on the surface of the aluminum plate thus treated. The adhesion between a substrate and a light-sensitive layer as will be detailed below can be greatly improved by the formation of such a hydrated oxide layer on the surface thereof prior to the subsequent anodization.

This hydrated oxide layer can be formed on the surface of an aluminum plate by a variety of known methods such as those disclosed in, for instance, an article entitled "As to Structures of Oxidized Layers Formed on Aluminum Surface" (see Collected Resume of 77th Lecture Meeting, p. 80; and an article of ISOYAMA & MUROOKA, Light Metals, 1990, 40(6), pp. 460–483. Specific examples of the methods for forming a hydrated oxide layer will be detailed below.

① A method comprising immersing an aluminum plate in hot water of 50° to 100° C.:

If tap water is used, the resulting hydrated oxide layer (a boehmite or bayerite layer) is colored brown, but the layer becomes clear during the subsequent anodization. Thus, tap water may be used in this treatment without any trouble.

In addition, the hot water used in this treatment may comprise an alkali such as ammonia, triethanolamine, monoethanolamine and diethanolamine for improving the growth speed of the boehmite layer.

② A method comprising heating aluminum plate in air at a temperature ranging from 100° to 300° C. to thus form a boehmite layer thereon.

③ A method comprising electrolyzing an aluminum plate by passing an electric current (DC or AC) through the aluminum plate which serves as an anode in an aqueous solution of boric acid, borax, $NaHSO_4$, $Na_2SO_4$, $NaH_2PO_4$, $Na_2HPO_4$, $NaH_2P_2O_7$ and/or $Na_2HP_2O_7$.

④ A method comprising etching the surface of an aluminum plate with an alkali or acid.

⑤ A method comprising electrolyzing an aluminum plate by passing a DC or AC current through the plate in a dilute solution of hydrochloric acid or nitric acid to form a hydrated oxide (smut) layer.

Among the foregoing methods for forming a hydrated oxide layer, industrially useful is a method comprising immersing an aluminum plate in an aqueous alkali solution having a pH ranging from 8 to 12. According to this method, the desired effect can be attained by the treatment for a short period of time. If the pH value of the treating solution is 13 or higher, the aluminum surface is vigorously etched and dissolved out and correspondingly any uniform hydrated oxide layer cannot be formed. If the aluminum plate is treated under such a high pH condition at a low temperature for a short time, for instance, at 50° C. for 15 seconds, the resulting hydrated oxide layer exhibits excellent adhesion, but is insufficient in stability. Thus, this treatment is preferably performed at a pH ranging from 8 to 12 and a temperature ranging from 50° to 100° C. in order to obtain a desired substrate having good adhesion.

Examples of the alkali agents used in the foregoing solutions are hydroxides of alkali metals and alkaline earth metals such as sodium hydroxide, potassium hydroxide, lithium hydroxide, calcium hydroxide and magnesium hydroxide; amines such as ammonia, triethanolamine, diethanolamine and monoethanolamine; and carbonates such as sodium carbonate and potassium carbonate.

Moreover, the solution may further comprise a surfactant for improving the surface-wettability of the aluminum plate such as saponin.

The treating time may properly be selected so that it falls within the range of from 5 to 300 seconds, preferably 5 to 100 seconds.

The surface of the aluminum plate on which a hydrated oxide layer has thus been formed is subsequently anodized in a sulfuric acid solution and the anodized layer is formed beneath the hydrated oxide layer. More specifically, there is accordingly obtained a substrate having a structure in which the hydrated oxide layer is positioned on the surface of the anodic oxide layer. The substrate thus obtained shows excellent adhesion to a light-sensitive layer subsequently applied onto the surface thereof.

The sulfuric acid electrolyte used in the anodization comprises 1 to 80% by weight, preferably 5 to 30% by weight of sulfuric acid and preferably an aluminum salt (such as aluminum sulfate) in an amount of 3 to 15 g/l expressed in terms of the amount of $Al^{3+}$ ions. The anodization is preferably carried out at a temperature ranging from 5° to 70° C., preferably 20° to 70° C., a voltage ranging from 1 to 100 V and a current density ranging from 3 to 60 A/dm$^2$, preferably 3 to 20 A/dm$^2$. Further, the anodization time generally ranges from 5 seconds to 50 minutes, in particular 5 to 300 seconds for forming an anodized layer having a desired thickness. The desired thickness of the anodic oxide layer ranges from 0.1 to 5 μm and the amount of the anodized layer to be formed ranges from 0.1 to 10 g/m$_2$, preferably 1 to 6 g/m$^2$.

The aluminum plate thus treated is subsequently hydrophilized. The hydrophilization is generally performed by immersing it in an aqueous solution of an alkali metal silicate such as JIS No. 3 sodium silicate as disclosed in U.S. Pat. No. 3,181,461, but may be performed by any known methods, for instance, the treatments with potassium fluorozirconate as disclosed in J.P. KOKOKU No. Sho 36-22063 and with polyvinylphosphonic acid as disclosed in U.S. Pat. No. 4,153,461.

A light-sensitive composition is applied onto the aluminum substrate thus obtained to form a light-sensitive layer thereon and to thus form a PS plate.

Examples of the light-sensitive layer usable in the present invention include photodimerizable light-sensitive layers, photopolymerizable light-sensitive layer and positive-working light-sensitive diazo compound layer comprising an o-quinone diazide.

Photodimerizable Light-sensitive Layer

As the photocrosslinkable polymers used in the photodimerizable light-sensitive layer, there may be mentioned, for instance, those carrying, on the side chains or in the main chain, maleimido group, cinnamyl group, cinnamoyl group, cinnamylidene group, cinnamylideneacetyl group and/or chalcone group.

Examples of the polymers carrying maleimido groups on the side chains include those represented by the following general formula (I):

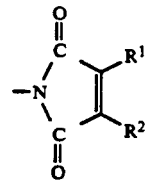

(I)

wherein $R^1$ and $R^2$ each independently represents an alkyl group having up to 4 carbon atoms or $R^1$ and $R^2$ may be bonded together to form a 5- or 6-membered carbon ring, as disclosed in J.P. KOKAI No. Sho 52-988 (corresponding to U.S. Pat. No. 4,079,041), German Patent No. 2,626,769, European Patent Nos. 21,019 and 3,552 and Die Angewandte Makromolekulare Chemie, 1983, 115, pp. 163–181; and those represented by the following general formula (II):

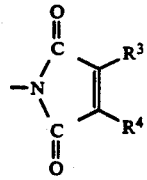

(II)

wherein $R^3$ represents an aromatic group and $R^4$ represents a hydrogen atom, a halogen atom, an alkyl group or a cyano group, as disclosed in J.P. KOKAI Nos. Sho 49-128991, Sho 49-128992, Sho 49-128993, Sho 50-5376, Sho 50-5377, Sho 50-5378, Sho 50-5379, Sho 50-50-50107, Sho 51-47940, Sho 52-13907, Sho 50-45076, Sho 52-121700, Sho 2,349,948 and 2,616,276. The molecular weight of these polymers is not less than 1,000 and preferably ranges from 30,000 to 500,000. These polymers have, on the side chains, at least two maleimido groups per molecule on the average.

In order to make these polymers having maleimido groups soluble in an alkaline water or swellable therewith, it is sufficient to introduce acidic groups in the polymers.

Specific examples of such acidic groups are those derived from carboxylic acid, sulfonic acid, phosphoric acid, phosphonic acid and alkali metal or ammonium salts thereof as well as those which are dissociated in alkaline water and have a pKa value ranging from 6 to 12 and typical examples thereof are—$SO_2NHCO$—, —CONHCO—, —$SO_2NHCOO$— and a p-hydroxyphenyl group. If necessary, one to three types of monomers containing such an acidic group may be copolymerized in the photocrosslinkable polymer. The photocrosslinkable polymer used in the present invention can easily be prepared by copolymerizing a monomer or monomers having such an acidic group with a monomer having a maleimido group at a molar ratio ranging, for example, from 10:90 to 50:50, preferably from 20:80 to 40:60.

The acid value of the polymers carrying maleimido groups and acidic groups preferably ranges from 30 to 300, more preferably from 50 to 250. Examples of preferred such monomers carrying an acidic group copolymerizable with the monomer having a maleimido group are vinyl monomers having a carboxyl group such as acrylic acid and methacrylic acid, maleic anhydride and itaconic anhydride.

Among these polymers having the acid value defined above, useful are copolymers of N-[6-(methacryloyloxy)hexyl]-2,3-dimethylmaleimide with (meth)acrylic acid as disclosed in Die Angewandte Makromolekulare Chemie, 1984, 128 , pp. 71–91. Moreover, any multicomponent copolymers can easily be prepared depending on various purposes by adding a vinyl monomer as a third component to the monomer mixture during the foregoing copolymerization. For instance, flexibility can be imparted to the resulting copolymer if an alkyl methacrylate or an alkyl acrylate whose homopolymer has a glass transition temperature of not more than room temperature is used as the vinyl monomer serving as the third monomer component.

Among other photocrosslinkable polymers carrying, on the side chains or in the main chain, cinnamyl groups, cinnamoyl groups, cinnamylidene groups, cinnamylideneacetyl groups and/or chalcone groups, those having, in the main chain, the following group:

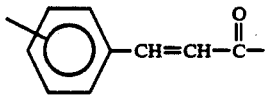

are, for instance, light-sensitive polyesters as disclosed in, for instance, U.S. Pat. No. 3,030,208 and U.S. Pat. Nos. 3,453,237 and 3,622,320. These polyesters are prepared by condensing a proper polycarboxylic acid or a proper lower alkyl ester or chloride thereof with a polyhydric alcohol in the presence of an esterification catalyst.

Examples of these photocrosslinkable polymers which are made alkaline water-soluble are those described in J.P. KOKAI Sho 60-191244, i.e., light-sensitive polymers obtained by reacting a polyester prepolymer which has a photodimerizable unsaturated double bond adjacent to an aromatic nucleus on the main chain, carboxyl groups on the side chains and a hydroxyl group at the terminal with a chain extender having at least two functional groups capable of reacting with a hydroxyl group such as diisocyanate compounds, diphenyl terephthalate, diphenyl carbonate or terephthaloylbis(N-caprolactam); and light-sensitive polymers obtained by reacting a polyester prepolymer or a polyurethane prepolymer which has a photodimerizable unsaturated double bond adjacent to an aromatic nucleus in the main chain and a hydroxyl group at the terminal with a chain extender such as pyromellitic dianhydride or cyclopentanetetracarboxylic dianhydride to introduce carboxyl groups on the side chains thereof.

In addition to the foregoing examples, there may also be used, for instance, alkaline water soluble or swellable light-sensitive polymers having photodimerizable functional groups and carboxyl groups on the side chains and an acid value ranging from 20 to 200. Specific examples of these light-sensitive polymers are disclosed in, for instance, J.P. KOKAI Nos. Sho 62-175729, Sho 62-175730, Sho 63-25443, Sho 63-218944 and Sho 63-218945 (U.S. Pat. No. 4,942,109 and Brit. Pat. No. 2204315).

The photocrosslinkable polymers used in the present invention desirably have a molecular weight of 1,000 or more, preferably from 10,000 to 500,000, more preferably from 20,000 to 300,000.

The amount of the foregoing photocrosslinkable polymers to be added to the light-sensitive layer ranges from 10 to 99% by weight (hereinafter referred to as simply "%"), preferably from 50 to 99%.

The light-sensitive layer used in the invention may comprise a sensitizer. As such sensitizers, preferred are triplet sensitizers having a maximum absorption so that it practically imparts, to the light-sensitive layer, sufficient light absorption at a wavelength of not less than 300 nm.

As such sensitizers, there may be mentioned, for instance, benzophenone derivatives, benzanthrone derivatives, quinones, aromatic nitro compounds, naphthothiazoline derivatives, benzothiazoline derivatives, thioxanthones, naphthothiazole derivatives, ketocoumarin derivatives, benzothiazole derivatives, naphthofuranone compounds, pyrylium salts and thiapyrylium salts. Specific examples thereof include Michler's ketones, N,N'-diethylaminobenzophenone, benzanthrone, (3-methyl-1,3-diaza-1,9-benz)anthrone picramide, 5-nitroacenaphthene, 2-chlorothioxanthone, 2-isopropylthioxanthone, dimethylthioxanthone, methylthioxanthone-1-ethylcarboxylate, 2-nitrofluorene, 2-dibenzoylmethylene-3-methylnaphthothiazoline, 3,3-carbonylbis(7-diethylaminocoumarin), 2,4,6-triphenylthiapyrylium perchlorate and 2-(p-chlorobenzoyl)naphthothiazole. The amount of the sensitizer desirably ranges from about 1 to about 20% by weight, preferably from 3 to 10% by weight on the basis of the weight of the light-sensitive layer.

The photodimerizable light-sensitive layer may further comprise, if necessary, a binder which is in general selected from linear organic polymers. Specific examples thereof are chlorinated polyethylene, chlorinated polypropylene, poly(alkyl acrylate), copolymers of alkyl acrylates with at least one monomer selected from acrylonitrile, vinyl chloride, styrene and butadiene; polyamides, methyl cellulose, polyvinylformal, polyvinylbutyral, methacrylic acid copolymers, acrylic acid copolymers and itaconic acid copolymers.

The light-sensitive layer may, if necessary, comprise a dye or a pigment for the purpose of dyeing the layer and/or a pH indicator as a printing out agent.

The light-sensitive layer may comprise a plasticizer or the like. Examples of plasticizers usable in the invention are dialkyl phthalate such as dibutylphthalate and dihexylphthalate; oligoethylene glycol alkyl esters or phosphoric acid esters.

Photopolymerizable Light sensitive Layer

Examples of the photopolymerizable light-sensitive layer include those comprising a polymerizable compound having an ethylenically unsaturated bond, a photopolymerization initiator and an alkaline water-soluble or alkaline water-swellable and film-forming polymer.

The polymerizable compound having an ethylenically unsaturated bond usable in a photopolymerizable composition for the photopolymerizable type light-sensitive layer is a compound having at least one ethylenically unsaturated bond in its chemical structure and may be in the form of monomer, prepolymers (such as dimer, trimer and other oligomers), mixture thereof or copolymers thereof. Examples thereof are unsaturated carboxylic acids and salts thereof, esters of unsaturated carboxylic acids with aliphatic polyhydric alcohols, and amides of unsaturated carboxylic acids with aliphatic polyvalent amines.

Specific examples of the unsaturated carboxylic acids are acrylic acid, methacrylic acid, itaconic acid, crotonic acid, isocrotonic acid and maleic acid. Specific examples of the salts of the unsaturated carboxylic acids are alkali metal salts of the foregoing unsaturated carboxylic acids such as sodium and potassium salts thereof.

Specific examples of the esters of unsaturated carboxylic acids with aliphatic polyhydric alcohols include acrylates such as ethylene glycol diacrylate, triethylene glycol diacrylate, 1,3-butanediol diacrylate, tetramethylene glycol diacrylate, propylene glycol diacrylate, trimethylolpropane triacrylate, trimethylolethane triacrylate, 1,4-cyclohexanediol diacrylate, tetraethylene glycol diacrylate, pentaerythritol diacrylate, pentaerythritol triacrylate, pentaerythritol tetraacrylate, dipentaerythritol diacrylate, dipentaerythritol triacrylate, dipentaerythritol tetraacrylate, dipentaerythritol hexaacrylate, sorbitol triacrylate, sorbitol tetraacrylate, sorbitol pentaacrylate, sorbitol hexaacrylate and polyester acrylate oligomers; methacrylates such as tetramethylene glycol dimethacrylate, triester glycol dimethacrylate, trimethylolpropane trimethacrylate, trimethylolethane trimethacrylate, ethylene glycol dimethacrylate, 1,3-butanediol dimethacrylate, pentaerythritol dimethacrylate, pentaerythritol trimethacrylate, dipentaerythritol dimethacrylate, sorbitol trimethacrylate, sorbitol tetramethacrylate, bis-[p-(3-methacryloxy-2-hydroxypropoxy)phenyl]-dimethylmethane and bis-[p-(methacryloxyethoxy)phenyl]-dimethylmethane; itaconates such as ethylene glycol diitaconate, propylene glycol diitaconate, 1,3-butanediol diitaconate, 1,4-butanediol diitaconate, tetramethylene glycol diitaconate, pentaerythritol diitaconate and sorbitol tetraitaconate; crotonates such as ethylene glycol dicrotonate, tetramethylene glycol dicrotonate, pentaerythritol dicrotonate and sorbitol tetracrotonate; isocrotonates such as ethylene glycol diisocrotonate, pentaerythritol diisocrotonate and sorbitol tetraisocrotonate; and maleates such as ethylene glycol dimaleate, triethylene glycol dimaleate, pentaerythritol dimaleate and sorbitol tetramaleate; as well as mixture of the foregoing esters.

Specific examples of the amides of unsaturated carboxylic acids with aliphatic polyvalent amines are methylenebis-acrylamide, methylenebis-methacrylamide, 1,6-hexamethylenebis-acrylamide, 1,6-hexamethylenebis-methacrylamide, diethylenetriaminetris-acrylamide, xylylenebis-acrylamide and xylylenebis-methacrylamide.

Specific examples thereof further include vinylurethane compounds having two or more polymerizable vinyl groups in a molecule which can be obtained by adding vinyl monomers having a hydroxyl group represented by the following general formula (III) to polyisocyanate compounds having two or more isocyanate groups in a molecule as disclosed in J.P. KOKOKU No. Sho 48-1708:

$$CH_2{=}C(R^5)COOCH_2CH(R^6)OH \quad \text{(III)}$$

wherein $R^5$ and $R^6$ each represents a hydrogen atom or a methyl group.

Examples of the photopolymerization initiator usable in the present invention are vicinal polyketaldonyl compounds as disclosed in U.S. Pat. No. 2,367,660; α-carbonyl compounds as disclosed in U.S. Pat. Nos. 2,367,661 and 2,367,670; acyloin ether compounds as disclosed in U.S. Pat. No. 2,448,828; aromatic acyloin compounds substituted with a hydrocarbon group at the α-position as disclosed in U.S. Pat. No. 2,722,512; polynuclear quinone compounds as disclosed in U.S. Pat. Nos. 3,046,127 and 2,951,758; a combination of triarylimidazole dimer/p-aminophenol ketone as disclosed in U.S. Pat. No. 3,549,367; benzothiazole type compounds as disclosed in U.S. Pat. No. 3,870,524; benzothiazole type compounds/trihalomethyl-s-triazine type compounds as disclosed in U.S. Pat. No. 4,239,850; acridine and phenadine compounds as disclosed in U.S. Pat. No. 3,751,259; and oxadiazole compounds as disclosed in U.S. Pat. No. 4,212,970, which may be used alone or in combination. The amount of the photopolymerization initiator ranges from about 0.5% by weight to about 15% by weight, preferably from 2 to 10% by weight on the basis of the total weight of the light-sensitive composition.

Examples of the alkaline water-soluble or alkaline water-swellable and film-forming polymers usable in the light-sensitive composition include copolymers of benzyl (meth) acrylate/(meth)acrylic acid/optional another addition polymerizable vinyl monomer as disclosed in J.P. KOKOKU No. Sho 59-44615 of copolymers of methacrylic acid/methyl or ethyl methacrylate-/alkyl methacrylate as disclosed in J.P. KOKOKU No. Sho 54-34327; (meth)acrylic acid copolymers as disclosed in J.P. KOKOKU Nos. Sho 58-12577 and Sho 54-25957 and J.P. KOKAI No. Sho 54-92723; copolymers of allyl (meth)acrylate/(meth)acrylic acid/optional another addition polymerizable vinyl monomer as disclosed in J.P. KOKAI No. Sho 59-53836; and maleic anhydride copolymers to which pentaerythritol triacrylate is added through half-esterification and acidic vinyl copolymers of vinyl methacrylate/methacrylic acid/optional another addition polymerizable vinyl monomer, which have a functional group selected from —COOH, $-PO_3H_2$, $-SO_3H$, $-SO_2NH_2$, $-SO_2NH$-CO— and have an acid value ranging from 50 to 200 as disclosed in J.P. KOKAI No. Sho 59-71048.

Particularly preferred are copolymers of benzyl (meth) acrylate/(meth)acrylic acid/optional another addition polymerizable vinyl monomer and copolymers of allyl (meth) acrylate/(meth)acrylic acid/optional another addition polymerizable vinyl monomer.

These polymers may be used alone or in combination. The molecular weight of these polymers may vary depending on the kinds thereof. Generally, it ranges from 5,000 to 1,000,000, preferably from 10,000 to 500,000. These polymers are used in an amount ranging from 10 to 90% by weight, preferably 30 to 85% by weight on the basis of the total weight of the light-sensitive composition.

The light-sensitive composition may further comprise heat polymerization inhibitors and antioxidants, of which examples include hydroquinone, p-methoxyphenol, di-t-butyl-p-cresol, pyrogallol, t-butyl catechol, benzoquinone, 4,4'-thiobis(3-methy-6-t-butylphenol), 2,2'-methylenebis(4-methy-6-t-butylphenol), 2-mercapto-benzimidazole and the like.

Positive-working light-sensitive diazo compound layer containing o-quinone diazide.

As preferred o-quinone diazide compounds, there can be mentioned o-naphthoquinone diazide compounds disclosed in many publications such as U.S. Pat. Nos. 2,766,118, 2,767,092, 2,772,972, 2,859,112, 2,907,665, 3,046,110, 3,046,111, 3,046,115, 3,046,118, 3,046,119, 3,046,120, 3,046,121, 3,046,122, 3,046,123, 3,061,430, 3,102,809, 3,106,465, 3,635,709 and 3,647,443, and they are advantageously used for the present invention.

Among those, particularly preferred are o-naphthoquinone-diazido-sulfonic acid esters or o-naphthoquinone-diazido-carboxylic acid esters of aromatic hydroxyl compounds and o-naphthoquinone-diazido-sulfonic acid amide or o-naphthoquinone-diazido-carboxylic acid amide of aromatic amino compounds, and more particularly preferred and advantageous are those compounds obtained by esterification of o-naphthoquinone-diazido-sulfonic acid with condensates of pyrogallol and acetone as disclosed in U.S. Pat. No. 3,635,709; those compounds obtained by esterification of o-naphthoquinone-diazido sulfonic acid or o-naphthoquinone-diazido-carboxylic acid with polyesters having a terminal hydroxyl group as disclosed in U.S. Pat. No. 4,028,111; those compounds obtained by esterification of o-naphthoquinone-diazido-sulfonic acid or o-naphthoquinone-diazido-carboxylic acid with p-hydroxystyrene homopolymer or p-hydroxystyrene copolymer comprising a monomer polymerizable with p-hydroxystyrene as disclosed in Brit. Patent No. 1,494,043; and those compounds obtained by amide-forming reaction of o-naphthoquinone-diazido-sulfonic acid or o-naphthoquinone-diazido-carboxylic acid with a copolymer of p-aminostyrene and a monomer copolymerizable therewith as disclosed in U.S. Pat. No. 3,759,711.

Though these o-quinone diazide compounds may be used alone, they are preferably used by mixing with an alkali soluble resin. As preferred alkali-soluble resins there can be mentioned novolak type phenol resins such as phenol/formaldehyde resin, o-cresol/formaldehyde resin and m-cresol/formaldehyde resin. Further, it is particularly preferable to use phenol resins such as those described above with a condensate of cresol or phenol substituted with an alkyl group containing 3 to 8 carbon atoms with formaldehyde such as t-butylphenol/formaldehyde resin. The alkali-soluble resin may be contained in the light-sensitive layer in an amount of about 50 to about 80% by weight, preferably 60 to 80% by weight based on the total weight of the composition constituting the light sensitive layer.

The light-sensitive composition containing o-quinone diazide compounds may optionally contain a dye, plasticizer, components for providing print out property such as disclosed in Brit. Patent Nos. 1,401,463, 1,039,475 and U.S. Pat. No. 3,969,118, and the like.

Examples of the dye include basic dyes such as Victoria Pure Blue BOH, Victoria Blue BR, Methyl Violet, Aizen Malachite Green (these are available from Hodogaya Chemical Industries, Ltd.), Patent Pure Blue VX, Rhodamine B and Methylene Blue (these are available from Sumitomo Chemical Industries, Ltd.), and oil-soluble dyes such as Sudan Blue II, Victoria Blue F4R (these are available from BASF), Oil Blue #603, Oil Blue BOS and Oil Blue IIN (these are available from Orient Chemical Industries, Ltd.).

Among these dyes, particularly preferred are the basic dyes, and the most preferred are those dyes of which the counter anion has a sulfonic acid group such as naphthalenesulfonic acid group as a sole exchange group.

The light-sensitive composition may be added with, as a photodegradable acid generating agent, 1,2-naphthoquinone-(2)-4-sulfonyl chloride, trihalomethyl-2-pyrrone and trihalomethyltriazine as disclosed in J.P. KOKAI No. Sho53-36223, various o-naphthoquinone diazide compounds as disclosed in J.P. KOKAI No. Sho 55-62444 and 2-trihalomethyl-5-aryl-1,3,4-oxadiazole compounds as disclosed in J.P. KOKAI No. Sho 55-77742.

Further detailed information of the light-sensitive layer containing o-quinone diazide compounds and developers therefor are described in U.S. Pat. No. 4,259,434.

Each of the above-described light-sensitive layers can be obtained by dissolving a light-sensitive composition which comprises the foregoing various ingredients in a proper solvent such as 2-methoxyethanol, 2-methoxyethyl acetate, methyl cellosolve, propylene glycol monomethyl ether, 3-methoxypropanol, 3-methoxypropyl acetate, acetone, methyl ethyl ketone, ethylene dichloride, methyl lactate, ethyl lactate, methanol, dimethylformamide, ethanol, methyl cellosolve acetate and a mixed solvent composed of any combination of these solvents and then applying the resulting coating solution onto a substrate. The coated amount of the light-sensitive layer desirably ranges from about 0.1 to about 10 g/m$^2$, preferably 0.5 to 5 g/m$^2$, particularly, in case of the positive-working type diazo compound layer, 1 to 3 gm$^2$ (weighed after drying).

The substrate for a lithographic printing plate according to the present invention may be provided with a light-sensitive layer other than the above-exemplified light sensitive layers.

In the present invention, an intermediate layer may be formed between the substrate and the light-sensitive layer for the purposes of improving the adhesion between the substrate and the light-sensitive layer, of preventing the light-sensitive layer from remaining unremoved on the substrate after development or of preventing halation. To improve the adhesion, the intermediate layer in general comprises, for instance, a diazo resin or a phosphoric acid compound capable of being adsorbed onto aluminum plates. In addition, the intermediate layer in general comprises a material having a high solubility such as polymers having a high solubility in developers or water-soluble polymers so that the light-sensitive layer does not remain after development. Moreover, the intermediate layer generally comprises a dye or UV absorber in order to prevent halation. The thickness of the intermediate layer is not restricted to a specific range, but should be one which makes it possible to cause a reaction for forming uniform bonds between the intermediate layer and the light-sensitive layer upon light exposure. In general, the coated amount thereof ranges from about 1 to 100 mg/m$^2$, particularly from 5 to 40 mg/m$^2$ (expressed in terms of the dry solid contents).

The intermediate layer may comprise various additives such as sensitizer, diazo stabilizing agent, polymer binder, halation preventing agent and surfactant.

Further, in order to prevent bad effects upon the presensitizing lithographic printing plate according to the present invention caused by oxygen such as reduction of sensitivity and deterioration of preserving stability, the plate may be further provided with a peelable cover sheet on the light-sensitive layer, a coating layer composed of, for example, wax-like material or water-soluble or alkaline soluble polymer showing a low oxygen permeability, and the like.

The presensitized lithographic printing plate according to the present invention may be made into a printing plate by imagewise light exposure and development in a conventional manner.

Preferred examples of the light source used in the light exposure include conventional light sources emmitting ultraviolet rays having a wavelength of not less than 180 nm or visible light such as carbon arc, high pressure mercury lamp, xenon lamp, metal halide lamp, argon ion laser, helium/cadmium laser and krypton laser.

The developer for the presensitised printing plate of the invention may be a diluted aqueous alkaline solution preferably containing not more than 10% by volume of organic solvent.

Examples of the alkaline compound for the alkaline solution include inorganic compounds such as sodium hydroxide, potassium hydroxide, lithium hydroxide, sodium silicate and sodium hydrogen carbonate, ammonia and organic compounds such as monoethanolamine. As the water-miscible solvent for the aqueous alkaline solution, iso-propyl alcohol, benzyl alcohol, ethyl cellosolve, diacetone alcohol or the like may be used. The developer may contain a surfactant, dye, salt for reducing swelling, salt for etching the substrate metal and the like.

The presensitized lithographic printing plate according to the present invention exhibits an extremely high sensitivity capable of being applied with the new light-exposure methods, strong adhesion of the light-sensitive layer and thereby excellent printing durability. Further, it is developable with an aqueous solution type developer and exhibits an excellent printability.

In particular, the positive-working type presensitized lithographic printing plate using a positive-working type light-sensitive diazo compound layer containing o-quinone diazide as the light-sensitive layer exhibits excellent adhesion between the image portion and the substrate, whereas it hardly shows coloring in non-image areas.

EXAMPLE

The present invention will be further illustrated by referring to the following non-limitative examples and the specific advantage of the invention will demonstrated by a comparison with data of the comparative examples described hereinafter.

EXAMPLE 1

An aluminum plate was electrolytically grained at a bath temperature of 25° C. and a current density of 50 A/dm$^2$ for 25 seconds in a bath having a hydrochloric acid concentration of 17 g/l to form grains whose maximum surface roughness was 4 μm.

The surface of the aluminum plate thus treated was washed with an aqueous solution of NaOH and then neutralized with an aqueous solution of $H_2SO_4$. Thereafter, the aluminum plate was immersed in boiling water of 100° C. for 5 minutes to form a hydrated oxide layer (a boehmite layer) on the surface of the plate. Then the plate was anodized at a temperature of 50° C. and a current density of 3 A/dm$^2$ for 2 minutes in an electrolyte comprising 160 g/l of sulfuric acid and 5 g/l of $Al^{+3}$ ions. After washing with water, the plate was immersed in a 2.5% aqueous solution of JIS No. 3 sodium silicate at 70° C. for 20 seconds, washed with water and dried to give an aluminum substrate I.

Light-sensitive composition I having the following composition was applied onto the surface of Substrate I in an amount of 1.0 g/m$^2$ (weighed after drying).

| Light-sensitive Composition I | |
|---|---|
| N-[6-(methacryloyloxy)hexyl]-2,3-dimethylmaleimide/ | 5 g |

-continued

| Light-sensitive Composition I | |
|---|---|
| methacrylic acid (molar ratio = 65:35) copolymer | |
| Sensitizer having the following formula: | 0.3 g |

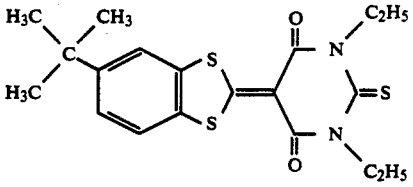

| | |
|---|---|
| propylene glycol monomethyl ether | 50 g |
| methyl ethyl ketone | 50 g |
| Defenser MCF-323 (available from Dainippon Ink & Chemicals, Incorporated) | 0.03 g |
| Oil Blue #603 (available from Orient Chemical Industries, Ltd.) | 0.07 g |

The resulting PS plate was exposed to light for 10 counts while a step guide available from Fuji Photo Film Co., Ltd. was brought into contact with the plate using Eye Rotary Printer available from Eye Graphics Co., Ltd. and was developed with Developer I having the following composition at 25° C. for 50 seconds. As a result, good images could be formed on the plate.

Separately, the PS plate was exposed to light and developed in the following manner. A transparent negative film obtained by scaling down a letter image and taking a photograph on a film of 35 mm was enlarged to a magnification of 6 using a projecting exposure machine (SAPP; available from Dainippon Screen Manufacturing Co., Ltd.) provided with a mercury lamp as a light source, the image was projected on the PS plate for 20 seconds for imagewise exposing the same and the plate was developed with Developer I.

As a result, a good letter image could be obtained.

| Developer I | |
|---|---|
| Sodium sulfite | 5 g |
| Benzyl alcohol | 30 g |
| Sodium carbonate | 5 g |
| Sodium isopropylnaphthalenesulfonate | 12 g |
| Pure water | 1000 g |

COMPARATIVE EXAMPLE 1

An aluminum plate was surface-treated in the same manner used in Example 1 except that the plate was not immersed in boiling water of 100° C., i.e., a hydrated oxide layer was not formed on the aluminum plate.

Thereafter, Light-sensitive Composition I was applied to the plate followed by imagewise exposure and development in the same manner used in Example 1. However, any image could not be formed.

Moreover, the resulting PS plate was exposed to light by projection and then developed under the same conditions used in Example 1.

However, a letter image could not be formed thereon.

EXAMPLE 2

The surface of an aluminum plate was mechanically grained by supplying a 20% suspension comprising water and pumice onto the surface while rubbing the surface with a rotary nylon brush. The surface roughness of the resulting plate was 0.5 μm. Then the plate was etched with a 5% NaOH aqueous solution at 50° C. for 10 seconds, immersed in a 20% by weight $H_2SO_4$ aqueous solution at 60° C. and then neutralized.

The resulting aluminum plate was immersed in a 0.5% ethanolamine aqueous solution maintained at 95° C. for 5 minutes to form a hydrated oxide layer on the surface thereof. Further, the plate was anodized at a current density of 1 A/dm$^2$ and 50° C. for 6 minutes in an electrolyte comprising 160 g/l of sulfuric acid and 10 g/l of $Al^{3+}$ ions. After water-washing, it was immersed in a 2.5% aqueous solution of JIS No. 3 sodium silicate at 70° C. for 15 seconds, washed with water and dried to give an aluminum substrate, Substrate II. Light-sensitive Composition II having the following composition was applied onto Substrate II in an amount of 1.0 g/m$^2$ (weighed after drying).

| Light-sensitive Composition II | |
|---|---|
| β-cinnamoyloxyethyl methacrylate/methacrylic acid (molar ratio = 70/30) copolymer | 5.0 g |
| Sensitizer having the following formula: | 0.4 g |

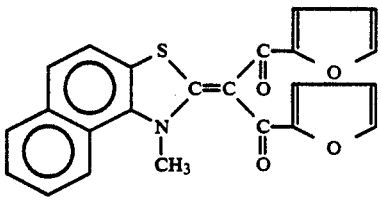

| | |
|---|---|
| Diethyl phthalate | 0.5 g |
| Cu-Phthalocyanine Pigment (CI Pigment Blue 15) (a 10% dispersion in a plasticizer) | 1.0 g |
| Megafack F-177 (available from Dainippon Ink & Chemicals, Incorporated) | 0.02 g |
| Methyl ethyl ketone | 20 g |
| Propylene glycol monomethyl ether | 30 g |

The PS plate thus obtained was imagewise exposed to light and developed with Developer I in the same manner used in Example 1. As a result, good images could be obtained (i.e., 12 steps of the step guide were clear).

COMPARATIVE EXAMPLE 2

An aluminum plate was surface-treated in the same manner used in Example 2 except that the plate was not immersed in a triethanolamine aqueous solution, i.e., a hydrated oxide layer was not formed on the aluminum plate. Thereafter, light-sensitive composition II was applied to the plate followed by imagewise exposure and development with Developer I in the same manner used in Example 2. However, only an image wherein 3 steps of the step guide were clear could be obtained.

The sensitivities of the PS plates obtained in Examples 1 and 2 and Comparative Examples 1 and 2 were determined. The results obtained are listed in Table 1 given below.

TABLE 1

| Ex. No. | Sensitivity (Number of Clear Steps of Step Guide) |
|---|---|
| 1 | 10 steps |
| 2 | 10 steps |
| 1* | (an image was not formed) |
| 2* | 3 steps |

*Comparative Example

The results listed in Table 1 indicates that in the PS plates of Examples 1 and 2, each substrate was strongly adhered to the light-sensitive layer due to the presence of a hydrated oxide layer on the substrate and these plates had high sensitivity.

EXAMPLE 3

A JIS A 1050 aluminum plate was grained using a 24% aqueous suspension of pumice and a rotary nylon brush. Then the plate was etched with a 5% by weight NaOH aqueous solution at 50° C. for 20 seconds. After washing with water and neutralizing with a 20% by weight $H_2SO_4$ aqueous solution at 50° C., the plate was subjected to an AC etching at a current density of 30 A/dm$^2$ for 2 minutes in a 1% HNO, aqueous solution. Then the plate was immersed in a 5% NaOH aqueous solution at 50° C. for 5 seconds and then neutralized with a 20% by weight $H_2SO_4$ aqueous solution at 60° C. for 10 seconds.

The aluminum plate thus treated was immersed in pure water of 100° C. for 5 minutes to form a hydrated oxide layer thereon and then anodized at a current density of 1 A/dm$^2$ and 45° C. for 6 minutes in an electrolyte comprising 160 g/l of sulfuric acid and 10 g/l of $Al^{3+}$ ions. After water-washing, the plate was immersed in a 2.5% aqueous solution of JIS No. 3 sodium silicate at 70° C. for 20 seconds, washed with water and then dried to give an aluminum substrate, Substrate III. Light-sensitive Composition III having the following composition was applied onto Substrate III in an amount of 1.0 g/m$^2$ (weighed after drying).

| Light-Sensitive Composition III | |
|---|---|
| Allyl methacrylate/methacrylic acid copolymer (copolymerization molar ratio = 70/30) | 5.0 g |
| Pentaerythritol tetraacrylate | 1.5 g |
| Lophine dimer/Michler's ketone | 0.3 g/0.3 g |
| p-Methoxyphenol | 0.01 g |
| Oil Blue #603 (available from Orient Chemical Industries Co., Ltd.) | 0.07 g |
| Megafack F-177 (available from Dainippon Ink & Chemicals, Incorporated) | 0.05 g |
| Ethylene glycol monomethyl ether | 100 g |
| Methanol | 50 g |
| Methyl ethyl ketone | 50 g |

An aqueous solution of polyvinyl alcohol (3% by weight; degree of saponification ranging from 86.5 to 89.0 mole %; degree of polymerization of not more than 1,000) was applied onto the surface of the light-sensitive layer, as an over coat layer, in an amount of 1.5 g/m$^2$ (weighed after drying) to give PS Plate (A).

COMPARATIVE EXAMPLE 3

An aluminum plate was surface-treated in the same manner used in Example 3 except that it was not treated with pure water, i.e., a hydrated oxide layer was not formed thereon. Thereafter, Light-sensitive Composition III was applied and then an over coat layer was formed thereon to give PS Plate (B) in the same manner used in Example 3.

EXAMPLE 4

After surface-treating an aluminum plate, Light-sensitive Composition IV having the following composition was applied onto the surface of the aluminum plate in an amount of 1.5 g/m$^2$ (weighed after drying) to give PS Plate (C), in the same manner used in Example 3.

| Light-sensitive Composition IV | |
|---|---|
| Allyl methacrylate/methyl methacrylate/methacrylic acid copolymer (copolymerization molar ratio = 60/20/20) | 5.0 g |
| Trimethylolpropane triacrylate | 2.0 g |
| Photopolymerization initiator represented by the following formula: | 0.3 g |

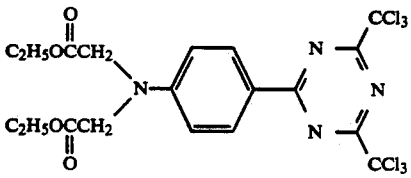

| | |
|---|---|
| Behenic acid amide | 0.2 g |
| Oil Blue #603 (available from Orient Chemical Industries Co., Ltd.) | 0.07 g |
| Megafack F-177 (available from Dainippon Ink & Chemicals, Incorporated) | 0.05 g |
| Ethylene glycol monomethyl ether | 100 g |
| Methyl ethyl ketone | 50 g |
| Methanol | 50 g |

COMPARATIVE EXAMPLE 4

PS Plate (D) was prepared in the same manner used in Example 3 except that an aluminum plate used was not treated with pure water or any hydrated oxide layer was not formed on the aluminum plate and that Light-sensitive composition III was substituted with Light-sensitive Composition IV.

Each of these PS Plates (A), (B), (C) and (D) thus prepared was brought into close contact with a step guide available from Fuji Photo Film Co., Ltd. and exposed to light for 25 counts using Printer FT26V20PNS manufactured and sold by U.S. Nu Arc Company, followed by development with Developer I at 25° C. for 40 seconds. The number of clear steps of the step guide was 10 steps for PS plates (A) and (C), while it was 2 steps for PS plates (B) and (D).

These results are summarized in Table 2 given below.

TABLE 2

| Ex. No. | Sensitivity (Number of Clear Steps of Step Guide) |
|---|---|
| 3 | 10 steps |
| 4 | 10 steps |
| 3* | 2 steps |
| 4* | 2 steps |

*Comparative Example

The results listed in Table 2 indicates that in the PS plates of Examples 3 and 4, each substrate was strongly adhered to the light-sensitive layer due to the presence of a hydrated oxide layer on the substrate and these plates had high sensitivity.

EXAMPLE 5

PS plate (C) prepared in Example 4 was brought into close contact with an original film for evaluation and exposed to light for 25 counts with Printer FT26V20PNS manufactured and sold by U.S. Nu Arc Company, followed by development with Developer I at 25° C. for 40 seconds to give a lithographic printing plate.

The printing durability of the printing plate was examined by performing printing operations using a printer, SPRINT L-225B available from Komori Printing Machinery Co., Ltd. As a result, the durability thereof for 4μ fine line portions of and image portions (solid portions) was found to be 100,000 copies as shown in Table 3.

COMPARATIVE EXAMPLE 5

PS plate (D) prepared in Comparative Example 4 was exposed to light, developed and subjected to test for printing durability in the same manner used in Example 5. As a result, that for 4μ fine line portions was 5,000 copies and the durability for image portions (solid portions) was found to be 70,000 copies.

TABLE 3

| Ex. No. | Printing Durability (number of Copies Acceptable) 4μ fine line portions | image (solid) portions |
|---|---|---|
| 5 | 100,000 | 100,000 |
| 5* | 5,000 | 70,000 |

*Comparative Example.

EXAMPLES 6 to 10 AND COMPARATIVE EXAMPLES 6 to 10

The surface of an aluminum plate was mechanically grained by supplying a 20% suspension comprising water and pumice onto the surface while rubbing the surface with a rotary nylon brush. The surface roughness of the resulting plate was 0.5 μm. Then the plate was etched with a 5% NaOH aqueous solution at 50° C. for 10 seconds, immersed in a 20% by weight $H_2SO_4$ aqueous solution at 60° C. and then neutralized.

The resulting aluminum plates each was immersed, at 100° C. for 30 seconds, in an aqueous solution of $H_2SO_4$ having a pH value of 1, 3 or 5 respectively (Comparative Examples 6 to 8), deionized water of pH 6 (Comparative Example 9), an aqueous solution of KOH having a pH value of 8, 9, 10, 11, 12 (Examples 6 to 10) or 13 (Comparative Example 10). Further, the plates were anodized at a current density of 10 A/dm$^2$ and 30° C. in an electrolyte comprising 170 g/l of sulfuric acid and 8 g/l of $Al^{3+}$ ions to form an anodic oxide layer in an amount of 3 g/m$^2$. Then these plates were immersed in a 2.5% aqueous solution of JIS No. 3 sodium silicate at 70° C. for 10 seconds. Light-sensitive Composition I having the composition defined in Example 1 was applied onto these substrates in an amount of 1.0 g/m$^2$ (weighed after drying).

The resulting PS plates were exposed to light for 10 counts while a step guide available from Fuji Photo Film Co., Ltd. was brought into contact with the plates using AI Rotary Printer and was developed with Developer I defined in Example 1 at 25° C. for 50 seconds. As a result, good images could be formed on the plates.

Separately, the PS plates were exposed to light and developed in the following manner. A transparent negative film obtained by scaling down a letter image and taking a photograph on a film of 35 mm was enlarged to a magnification cf 6 using a projecting exposure machine (SAPP; available from Dainippon Screen Manufacturing Co., Ltd.) provided with a mercury lamp as a light source, the image was projected on the PS plates for 20 seconds for imagewise exposing the same and the plate was developed with Developer I.

As a result, good letter images could be obtained.

After development, a commercially available tape was adhered to the surface of each light-sensitive layer to perform tape-peel test of the light-sensitive layer. The results thus obtained are listed in the following Table 4.

TABLE 4

| Ex. No. | pH of Processing Solution | No. of Solid Step of the Step Guide | No. of Step Peeled off in the Peel Test |
|---|---|---|---|
| 6* | 1 | not adhered | — |
| 7* | 3 | " | — |
| 8* | 5 | " | — |
| 9* | 6 | 3.5 steps | 9 steps |
| 6 | 8 | 3.5 steps | 0 |
| 7 | 9 | 3.5 steps | 0 |
| 8 | 10 | 4.0 steps | 0 |
| 9 | 11 | 4.0 steps | 0 |
| 10 | 12 | 3.5 steps | 0 |
| 10* | 13 | not adhered | — |

*Comparative Example.

The results shown in the foregoing Table indicate that a PS plate having good adhesion between the substrate and the light-sensitive layer thereof could be obtained by treating the aluminum substrate at a pH ranging from 8 to 12 for a short time period (30 seconds).

EXAMPLES 11 TO 16 AND COMPARATIVE EXAMPLES 11 TO 13

A JIS 1050 aluminum sheet was grained with a pumice-water suspension, as an abrasive, and a nylon brush. The surface roughness of the sheet at this stage was 0.5μ (center line averaged surface roughness). After water-washing, the sheet was immersed in a 10% aqueous solution of caustic soda warmed at 70° C. to etch it so that the amount of aluminum dissolved was equal to 6 g/m². After water-washing, the sheet was immersed in a 30% nitric acid aqueous solution for one minute, neutralized and sufficiently washed with water. Then the sheet was electrolytically surface-roughened for 20 seconds in a 0.7% nitric acid aqueous solution using rectangular alternating waved current having an anodic voltage of 13 V and a cathodic voltage of 6 V (the power source having a wave form disclosed in Examples of J.P. KOKAI No. Sho 52-77702), then immersed in a 20% sulfuric acid solution to wash the surface thereof and washed with water.

The surface of the sheet was treated as follows:

(1) Deionized water was boiled and the sheet was immersed therein for 5 minutes (Examples 11 to 13).

(2) A solution whose pH was adjusted to 9 with KOH was boiled at 100° C. and the sheet was immersed therein for one minute ((Examples 14 to 16).

At the same time, substrates free of these treatments (Comparative Examples 11 to 13) were also provided and these substrates were anodized in a 175 g/l sulfuric acid solution (containing 7.5 g/l of $Al^{3+}$ ions) at 30° C. to form an anodic oxide layer of 1, 2 and 3 g/m², respectively.

Light-sensitive Composition V having the following composition was applied onto the surface of these substrates thus prepared so that the coated amount thereof was 2.5 g/m² (weighed after drying) to form a light-sensitive layer.

| Light-sensitive Composition V | |
|---|---|
| Ester compound of naphthoquinone-1,2-diazido-5-sulfonyl chloride with pyrogallol/acetone resin (compound disclosed in Example 1 of U.S. Pat. No. 3,635,709) | 0.75 g |
| Cresol/novolak resin | 2.00 g |
| Oil Blue #603 (available from Orient Chemical Industries Co., Ltd.) | 0.04 g |
| Ethylenedichloride | 16 g |
| 2-Methoxyethyl acetate | 12 g |

Each PS plate thus prepared was imagewise exposed to light from a 3 KW metal halide lamp at a distance of 1 m for 50 seconds through a transparent positive film in a vacuum printing frame and then developed with a 5.26% aqueous solution (pH=12.7) of sodium silicate whose molar ratio: $SiO_2/Na_2O$ was 1.74.

After the development, the degree of coloration of the non-image area was determined by ultraviolet spectrophotometry (the difference between the substrate which was not colored and the colored substrate was expressed in terms of the difference in the optical density at 600 nm). Moreover, printing operations were performed using the resulting lithographic printing plates. The numbers of acceptable copies (corresponding to printing durability) were listed in the following Table 5.

The results listed in Table 5 indicate that the method of the present invention could achieve excellent desired effects.

TABLE 5

| Ex. No. | Amount of Anodic oxide layer (g/m²) | Degree of coloration | Printing Durability (No. of Copies) |
|---|---|---|---|
| 11 | 1.0 | 0.005 | 110,000 |
| 12 | 2.0 | 0.008 | 130,000 |
| 13 | 3.0 | 0.078 | 130,000 |
| 14 | 1.0 | 0.009 | 110,000 |
| 15 | 2.0 | 0.003 | 130,000 |
| 16 | 3.0 | 0.034 | 140,000 |
| 11* | 1.0 | 0.043 | 110,000 |
| 12* | 2.0 | 0.070 | 120,000 |
| 13* | 3.0 | 0.148 | 120,000 |

What is claimed is:

1. A method for preparing a presensitized plate for use in making a lithographic printing plate, which comprises the steps of, in order, forming a hydrated oxide layer on a surface of an aluminum plate by immersing the aluminum plate in an aqueous alkali solution having a pH ranging from 8 to 12, anodizing the aluminum plate having the hydrated oxide layer in a sulfuric acid electrolyte and providing a lithographically suitable light-sensitive layer on the anodized aluminum plate.

2. The method of claim 1, wherein said alkali is an alkali metal hydroxide, an alkaline earth metal hydroxide, an amine or a carbonate.

3. The method of claim 1, wherein said alkali is sodium hydroxide, potassium hydroxide, lithium hydroxide, calcium hydroxide, magnesium hydroxide, ammonia, triethanolamine, diethanolamine, monoethanolamine, sodium carbonate or potassium carbonate.

4. The method of claim 1, wherein the aqueous alkali solution has a temperature ranging from 50° to 100° C.

5. The method of claim 1, wherein the aluminum plate is immersed in the aqueous alkali solution for a period of from 5 to 300 seconds.

6. The method of claim 1, wherein the method further comprises immersing the anodized aluminum plate in an aqueous solution of an alkali metal silicate, before the step of providing the light-sensitive layer.

7. The method of claim 1, wherein the light-sensitive layer is a photodimerizable light-sensitive layer.

8. The method of claim 1, wherein the light-sensitive layer is a photopolymerizable light-sensitive layer.

9. The method of claim 1, wherein the light-sensitive layer is a positive-working light-sensitive diazo compound layer comprising an o-quinone diazide.

10. The method of claim 1, wherein the amount of the light-sensitive layer applied onto the substrate ranges from about 0.1 to about 10 g/m² expressed in terms of the dried weight thereof.

11. The method of claim 1, wherein the presensitized plate is provided with an intermediate layer between the substrate and the light-sensitive layer.

* * * * *